US005144966A

United States Patent [19]

Washington

[11] Patent Number: 5,144,966

[45] Date of Patent: Sep. 8, 1992

[54] FILAMENTARY FLAVORANT-RELEASE ADDITIVE FOR SMOKING COMPOSITIONS

[75] Inventor: James M. Washington, Richmond, Va.

[73] Assignees: Philip Morris Incorporated, New York, N.Y.; Philip Morris Products Inc., Richmond, Va.

[21] Appl. No.: 750,939

[22] Filed: Aug. 28, 1991

Related U.S. Application Data

[62] Division of Ser. No. 625,923, Dec. 11, 1990.

[51] Int. Cl.[5] ..... A24B 15/18; A24B 3/12; B29C 63/00; D02G 3/00

[52] U.S. Cl. ..... 131/335; 131/352; 131/353; 131/359; 264/171; 428/373; 428/375

[58] Field of Search ..... 131/335, 352, 353, 359; 264/171, 183, 186, 211.16, 217; 428/373, 375, 378; 426/515

[56] References Cited

U.S. PATENT DOCUMENTS

| | | | |
|---|---|---|---|
| 3,922,360 | 11/1975 | Sneath | 426/515 |
| 3,943,220 | 3/1976 | Barnett et al. | 264/183 |
| 5,070,891 | 12/1991 | Rutherford | 131/270 |

*Primary Examiner*—V. Millin
*Attorney, Agent, or Firm*—James E. Schardt

[57] ABSTRACT

In one embodiment this invention provides a cigarette product which contains a novel type of encapsulated flavorant-release filament. The flavorant is released under normal smoking conditions.

6 Claims, No Drawings

FILAMENTARY FLAVORANT-RELEASE ADDITIVE FOR SMOKING COMPOSITIONS

This application is a division of application Ser. No. 625,923, filed Dec. 11, 1990.

BACKGROUND OF THE INVENTION

A variety of flavorants have been developed and proposed for incorporation into tobacco products. Illustrative of such tobacco flavorants are those described in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,937,228; 3,943,943; 3,568,387; 3,379,754; and the like.

The high degree of volatility and ease of sublimation of flavorant additives in tobacco products have presented problems in the manufacturing operations, and have resulted in a decreased shelf-life of the products due to losses of flavorant by evaporation on storage.

Recent developments have involved incorporating a low volatility organic additive to a smoking composition, which under smoking conditions is pyrolyzed into one or more fragments that function to improve the taste and character of mainstream tobacco smoke, and in some cases a consequential improvement of sidestream smoke aroma.

U.S. Pat. No. 3,312,226 describes smoking tobacco compositions which contain an ester additive such as l-menthyl linalool carbonate. Under smoking conditions pyrolysis of the carbonate ester releases menthol which flavors the mainstream smoke.

U.S Pat. No. 3,332,428 and U.S. Pat. No. 3,419,543 describe smoking tobacco compositions which contain a menthyl carbonate ester of a glycol or saccharide, which under smoking conditions decomposes to release free menthol into the mainstream smoke. U.S. Pat. No. 3,499,452 discloses similar smoking tobacco compositions in which a carbonate ester additive releases flavorant volatiles other than menthol.

Another method being practiced for preventing premature volatilization of a smoking composition flavorant additive is by the utilization of microcapsules which encapsulate a flavorant that is being incorporated in the combustible filler. One disadvantage of this technique is the tendency for the microcapsules to separate from the filler and produce products with variable quantities of flavorant.

U.S. Pat. No. 4,889,144 describes a method wherein microcapsules containing encapsulated flavorant are introduced into the filter portion of a cigarette rather than the combustible filler. The release of the flavorant is achieved by applying pressure to the filter to rupture the microcapsules and release the encapsulated flavorant.

There is continuing research effort to develop novel flavorant-release additives, and low delivery smoking compositions which generate mainstream smoke with enhanced taste and sidestream smoke with a pleasant aroma under smoking conditions.

Accordingly, it is an object of this invention to provide smoking compositions having incorporated therein a flavorant-release component which is characterized by lack of mobility and/or volatility under product storage conditions.

It is another object of this invention to provide a flavorant-release additive in the form of a filament for incorporation in the combustible filler of cigarette products.

It is a further object of this invention to provide a process for the production of a flavorant-release additive for cigarette products which is in the form of a filament that releases encapsulated flavorant under normal cigarette smoking conditions.

Other objects and advantages of the present invention shall become apparent from the following description and example.

DESCRIPTION OF THE INVENTION

One or more objects of the present invention are accomplished by the provision of a process for producing a flavorant-release filament which comprises (1) extruding an aqueous mixture of flavorant compound and polysaccharide binder through an inner coaxial nozzle to form a gelled core fiber; (2) simultaneously coextruding an aqueous solution of water-soluble alginate salt through an outer coaxial nozzle to apply a coextensive sheath coating on the core fiber and form a continuous filament matrix; (3) contacting the filament with an aqueous calcium compound solution to convert sodium alginate to insoluble calcium alginate in the filament sheath coating and encapsulate the flavorant; and (4) subjecting the filament to drying conditions to remove water from the filament matrix.

The flavorant content in the filament is between about 2–65 weight percent, based on filament dry weight.

The polysaccharide binder in step(1) typically is incorporated in a quantity between about 0.5–5 weight percent of the aqueous mixture, and is selected from water-soluble or water-dispersible polysaccharides such as guar, starch, gum arabic, tragacanth, locust bean gum, pectin, alginate, carboxymethylcellulose, xanthan gum, and the like.

The alginate salt in step(2) is a water-soluble salt such as sodium alginate, potassium alginate or ammonium alginate.

The aqueous bath in step(3) is preferably an aqueous solution of a calcium compound which can dissolve and form a solution concentration of about 5 weight percent or higher, such as calcium chloride, calcium hydroxide, calcium acetate, calcium gluconate, and the like.

The flavorant which is encapsulated in the filament by the invention process can be selected from the large variety of known materials such as menthol, licorice, clove, anise, cinnamon, sandalwood, geranium, rose oil, vanilla, lemon oil, cassia, spearmint, fennel, ginger, and the like. The encapsulated material in the filament also can be in the form of a flavorant-release compound, such as the carbonate esters disclosed in U.S. Pat. Nos. 3,312,226 and 3,499,452.

In another embodiment this invention provides a novel monofilament product consisting of a core matrix and a coextensive sheath coating, wherein the core matrix comprises a mixture of flavorant compound, sodium alginate and calcium alginate, and the sheath coating comprises a non-porous calcium alginate film. The filament has a diameter between about 60–600 microns, and the sheath thickness is between about 5–20 microns.

An invention monofilament can have a core matrix which consists of alternating sections of the core mixture containing flavorant and the core mixture not containing flavorant, in a "bead-string" structural conformation. The bead-string conformation is provided by pulsing the flow of flavorant into admixture with the core sodium alginate solution during the coaxial stream formation phase.

In another embodiment this invention provides a cigarette product which has a combustible filler matrix selected from natural tobacco, reconstituted tobacco and tobacco substitutes, and the filler matrix contains a flavorant-release monofilament which is coextensive with the length of the filler matrix; wherein the monofilament consists of a core body and a coextensive sheath coating, and the core body comprises a mixture of flavorant compound, sodium alginate and calcium alginate, and the sheath coating comprises a non-porous calcium alginate film; and wherein the monofilament releases the flavorant compound as a volatile component of smoke under normal smoking conditions.

A cigarette product of the present invention can be produced with a conventional cigarette manufacturing assembly. The flavorant-release monofilament on a reel module can be fed continuously to the moving cigarette wrapper strip in coordination with the combustible filler feed stream. More than one monofilament feed line can be employed to introduce multiple filaments in the final product. The filament length normally will coincide with the tobacco rod segment at the cigarette cutting stage.

Alternatively, the filament can be cut into small segments which then are blended into the filler. As a further variation fine particles of ground tobacco can be coated on the filament surface for aesthetic reasons during manufacture of the filament.

A present invention cigarette product has several advantages in addition to ease of fabrication. There is no movement of the monofilament during handling and storage, and the problem of flavorant additive separation from the combustible filler is eliminated. There is essentially no migration of a volatile-type flavorant such as menthol during storage of the cigarette product. This permits the use of activated carbon filters on menthol cigarettes without any poisoning of the carbon adsorption activity.

Under normal smoking conditions, there is efficient release of the flavorant into the mainstream smoke.

The following example is further illustrative of the present invention. The components and specific ingredients are presented as being typical, and various modifications can be derived in view of the foregoing disclosure within the scope of the invention.

EXAMPLE

This Example illustrates the preparation of a monofilament containing encapsulated menthol flavorant in accordance with the present invention.

A solution containing 2 percent by weight of "Kelgin LV" sodium alginate (Kelco, Chicago, Ill.) in water was prepared. Synthetic menthol (m.p. -42° C.) was charged to a first supply tank enclosed in a heated water bath, and heated to a molten state. Sodium alginate solution was charged to a second supply tank similarly enclosed. A third heated tank was charged with more of the sodium alginate solution. The heated water bath was ultrasonically agitated to remove any small bubbles of air entrained in the sodium alginate solutions. All of the supply tanks were air pressurized to 80 psig, providing positive feed to the three "Zenith" metering pumps used to feed the nozzle system.

The nozzle system was comprised of an ultrasonic emulsifier (Cole-Parmer) fitted with an in-line mixing cell, and coaxial tubes. The central tube was supplied with emulsified molten menthol and sodium alginate solution. The outer tube was supplied only with alginate solution. The system was operated with the following flow rates:

| | |
|---|---|
| Menthol | 3.0 cc/min. |
| Core Sodium Alginate | 17.0 cc/min. |
| Sheath Sodium Alginate | 40.0 cc/min. |

The resulting coaxial stream, consisting of a central core of menthol/sodium alginate emulsion and a sheath coating of sodium alginate solution, was introduced continuously into a room temperature bath of a 5% aqueous calcium chloride solution, and a gelled filament matrix was withdrawn continuously from the solution. The withdrawn filament was wound on a plastic rotating drum (approximately 13" in diameter). The surface speed of the drum was about 100 meters/minute. The filament then was removed from the drum in about 6-foot lengths, and dried at room temperature.

After drying was completed, samples of the filament were analyzed and found to have a content of about 4-5 percent menthol by weight. Electron micrographs of the filament cross-section indicated a central core having a closed cell structure, surrounded by a relatively uniform and non-porous sheath film of calcium alginate.

In another embodiment, a "bead-string" structural conformation in the filament core matrix is provided by pulsing the flow of menthol/sodium alginate emulsion during the coaxial stream formation phase.

What is claimed is:

1. A filament consisting of a core matrix and a coextensive sheath coating, wherein the core matrix comprises a mixture of flavorant compound and polysaccharide binder, and the sheath coating comprises a non-porous calcium alginate film.

2. A filament in accordance with claim 1 which has a diameter between about 60–600 microns, and the sheath thickness is between about 5–20 microns.

3. A filament in accordance with claim 1 wherein the core matrix consists of alternating matrix sections containing flavorant and not containing flavorant in a bead-string structural conformation.

4. A filament in accordance with claim 1 wherein the flavorant compound in the core matrix is menthol.

5. A cigarette product which has a combustible filler matrix selected from natural tobacco, reconstituted tobacco and tobacco substitutes, and the filler matrix contains a flavorant-release filament which is coextensive with the length of the filler matrix; wherein the filament consists of a core body and a coextensive sheath coating, and the core body comprises a mixture of flavorant compound and polysaccharide binder, and the sheath coating comprises a non-porous calcium alginate film; and wherein the filament releases the flavorant compound as a volatile component of smoke under normal smoking conditions.

6. A cigarette product in accordance with claim 5 wherein the flavorant is menthol.

* * * * *